US005806203A

United States Patent [19]

Robinson

[11] Patent Number: 5,806,203

[45] Date of Patent: Sep. 15, 1998

[54] COMBINATION DRYING UNIT

[76] Inventor: Joe M. Robinson, 1334 Timberlane Rd., Tallahassee, Fla. 32312

[21] Appl. No.: 863,481

[22] Filed: May 27, 1997

[51] Int. Cl.[6] ..... F26B 19/00

[52] U.S. Cl. ..... 34/90; 34/215; 34/218; 242/559; 242/560

[58] Field of Search ..... 34/90, 202, 427, 34/210, 215, 218; 4/619, 628, 630; 312/228, 34.1; 242/559, 560

[56] References Cited

U.S. PATENT DOCUMENTS

| | | | |
|---|---|---|---|
| 3,305,938 | 2/1967 | Goldstein | 34/90 X |
| 3,587,437 | 6/1971 | McEwen | 454/339 |
| 3,785,523 | 1/1974 | Goldstein | 221/42 |
| 5,442,867 | 8/1995 | Robinson | 34/90 |
| 5,604,992 | 2/1997 | Robinson | 34/90 |

*Primary Examiner*—Henry A. Bennett
*Assistant Examiner*—Steve Gravini
*Attorney, Agent, or Firm*—Peter Loffler

[57] ABSTRACT

A combination drying unit has a towel roll rotatably held within a housing. An air blower, powered by a motor, is also held within the housing. The motor provides a stream of air from the air blower through an opening in the housing. The motor also powers, via an appropriate transmission unit, a guide roller, which engages a towel stream and dispenses the stream through a second opening. A sensor detects a towel outage within the device and communicates, in appropriate fashion, the towel outage condition.

19 Claims, 7 Drawing Sheets

COMBINATION DRYING UNIT

BACKGROUND OF THE INVENTION

1. Field of the Invention

The present invention relates to a drying unit capable of dispensing a stream of air as well as a towel stream.

2. Background of the Prior Art

The utility of providing a combination air stream dispenser and a towel stream, dispenser in one cooperative device is well known, the benefits of which have been explored in my U.S. Pat. Nos. 5,442,867 and 5,604,992 and will not be discussed further here. However, I have discovered further utility in providing a combination drying unit that minimizes parts and simplifies construction and maintenance and operating efficiency. Specifically, a drying unit utilizing a single motor for the combined function of air stream dispensing and towel dispensing is relatively easier to design, construct and maintain.

SUMMARY OF THE INVENTION

The combination drying unit of the present invention adds to the teachings of my prior patents identified above. Specifically, this invention provides for a drying unit having an air dispenser powered by the motor. The air dispenser dispenses a stream of air, which can optionally be heated, through an opening permitting a user to dry his hands or face. The motor also powers a dispensing unit that dispenses a towel from either a towel roll. A shaft, rotatable with motor activation, extends outwardly from the motor, and after optionally passing through the air blower, is received within a transmission unit that provides the interface between the motor and the dispensing unit. The use of a single motor coupled to a transmission unit eliminates the need for a second motor thereby saving manufacturing and maintenance costs. The transmission unit, which may be of any appropriate type and design known in the art, provides the necessary speed reduction of the motor output and provides the necessary torque to the towel dispensing unit.

BRIEF DESCRIPTION OF THE DRAWINGS

Similar reference numerals refer to similar parts throughout the several views of the drawings.

DESCRIPTION OF THE PREFERRED EMBODIMENT

Figure 1:
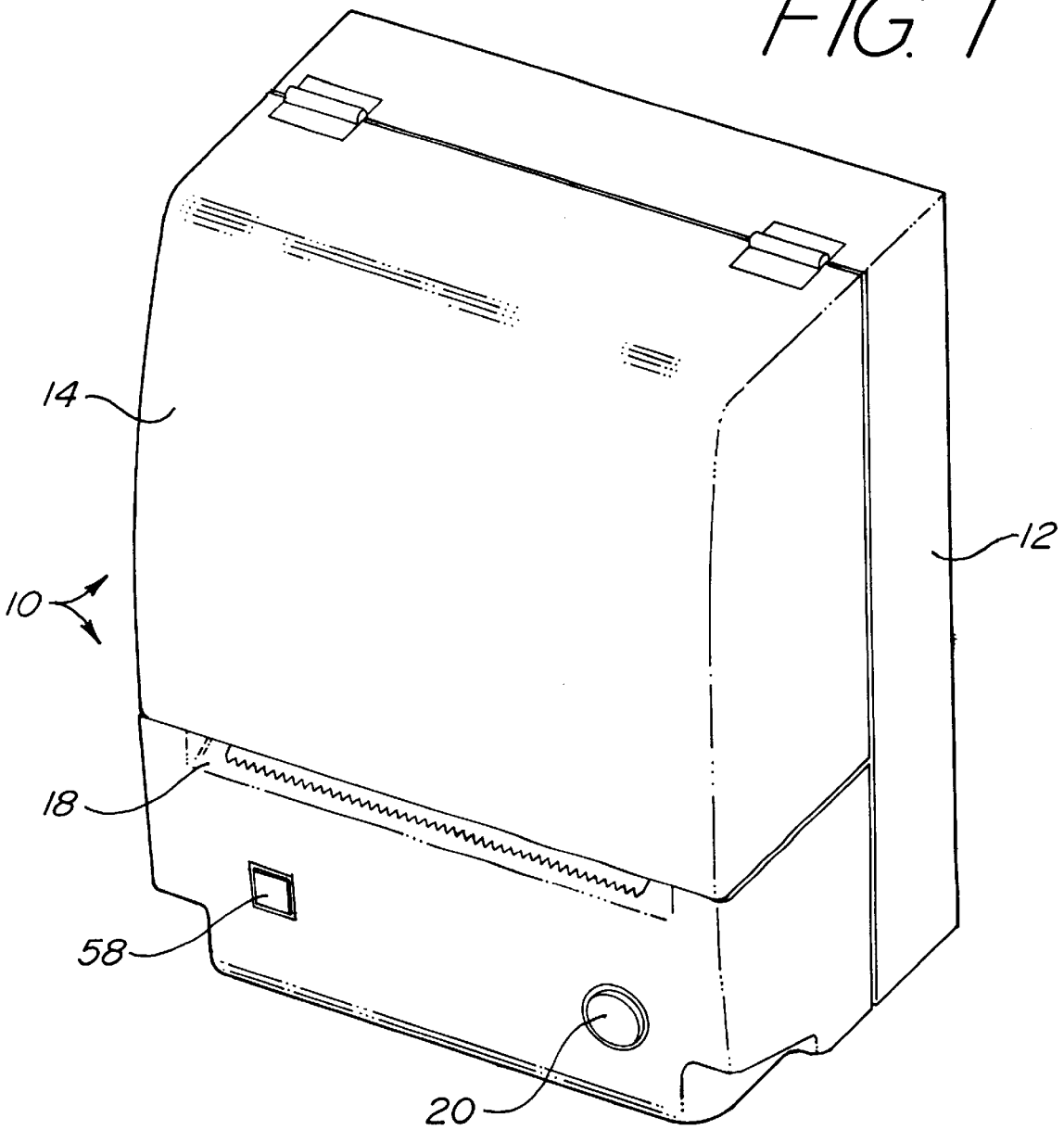
FIG. 1 is an upper perspective view of the combination drying unit of the present invention.
Figure 2:
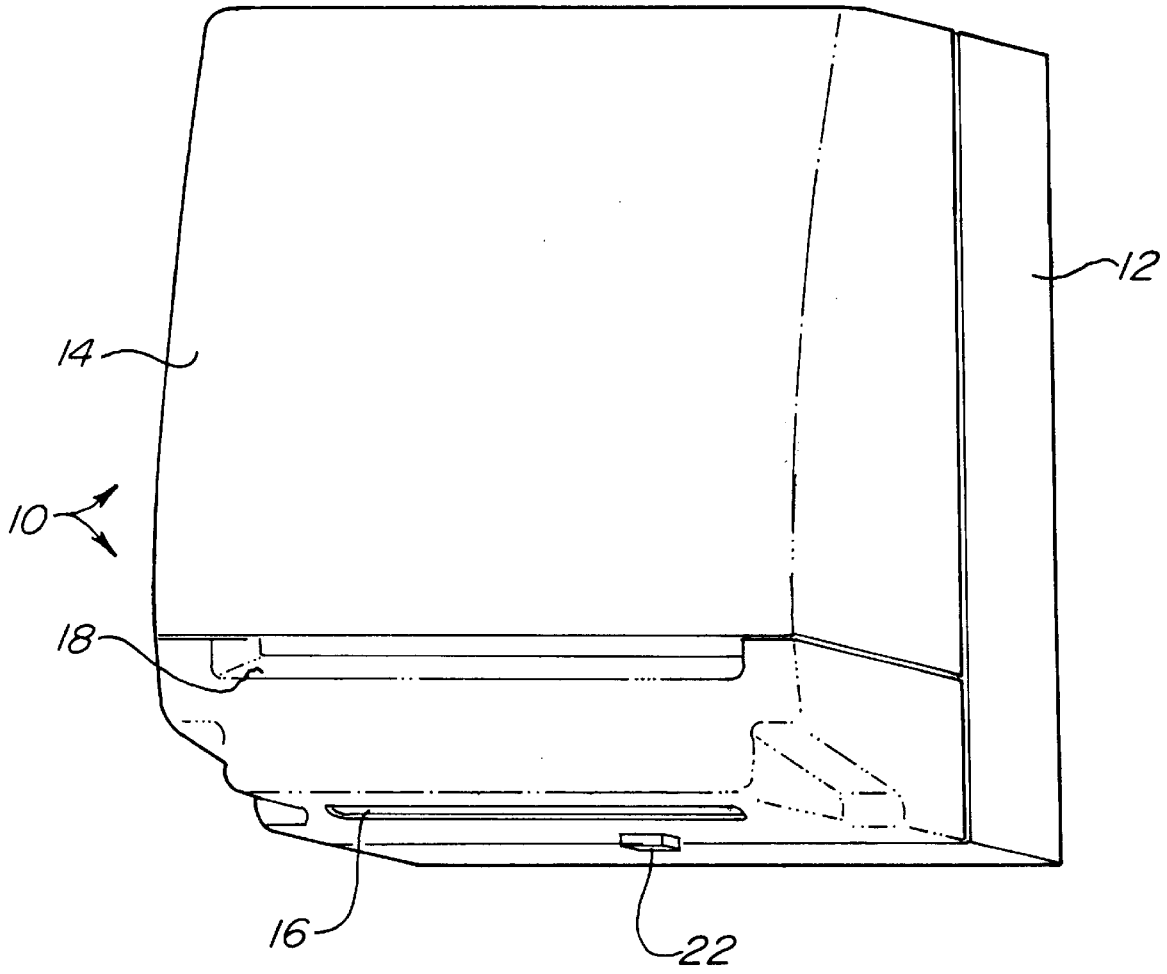
FIG. 2 is a lower perspective view of the combination drying unit.

Referring now to the drawings, it is seen that the combination drying unit of the present invention, generally denoted by reference numeral 10, is comprised of a housing 12 having a front cover 14 hingedly or removably attached thereto. The housing 12 is attachable to a wall or other structure in appropriate fashion. Latch means (not illustrated) of any appropriate design, hold the front cover 14 securely to the housing 12. As seen in FIGS. 1 and 2, the device 10 has a first opening 16 and a second opening 18. A cutting element (not illustrated) can be located proximate the second opening 18. An activation means is located on the device 10. The activation means can be of any appropriate design including the push button 20 illustrated in FIG. 1 or the "electric eye" 22 illustrated in FIG. 2. An air blower 24 powered by a motor 26 is disposed within the housing 12. The motor shaft 28 of the motor drives the air blower 24 and causes the air blower 24 to blow a stream of air, optionally through a heater element (not illustrated) for heated air, through the first opening 16 onto a user's hands. Although not illustrated, it is recognized that the first opening 16 may be configured as a nozzle, which may be rotatable, of any appropriate type well known in the art.

The motor shaft 28 extends beyond the end of the air blower and the end of the motor shaft 28 is received within a transmission unit 30. A first drive wheel 32 is rotatably attached to the end of the motor shaft 28. The motor shaft 28 and its attached first drive wheel 32 rotate whenever the motor 26 is activated.

Figure 3:
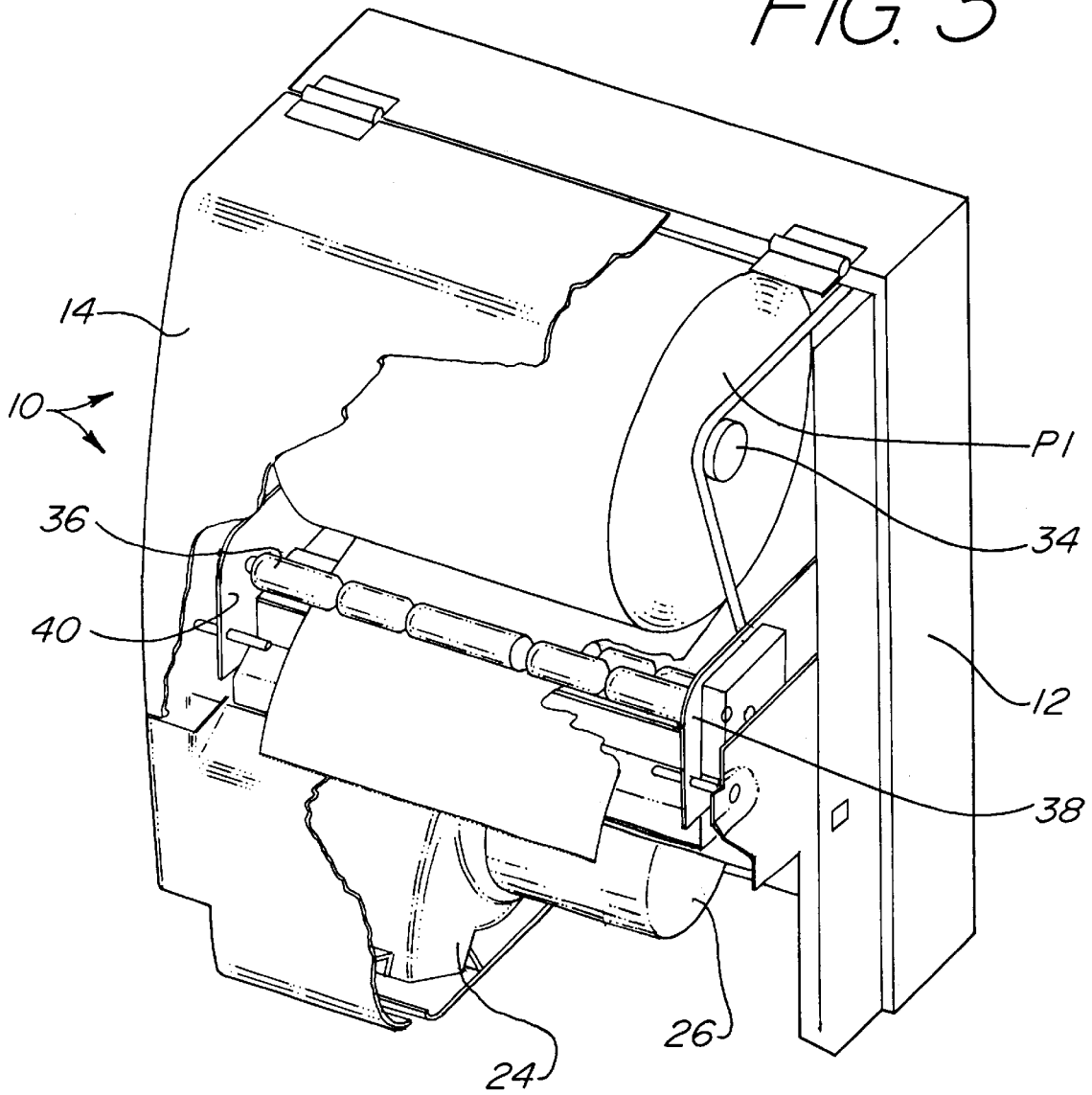
FIG. 3 is an upper perspective view of the combination drying unit having the cover partially cut away.
Figure 4:
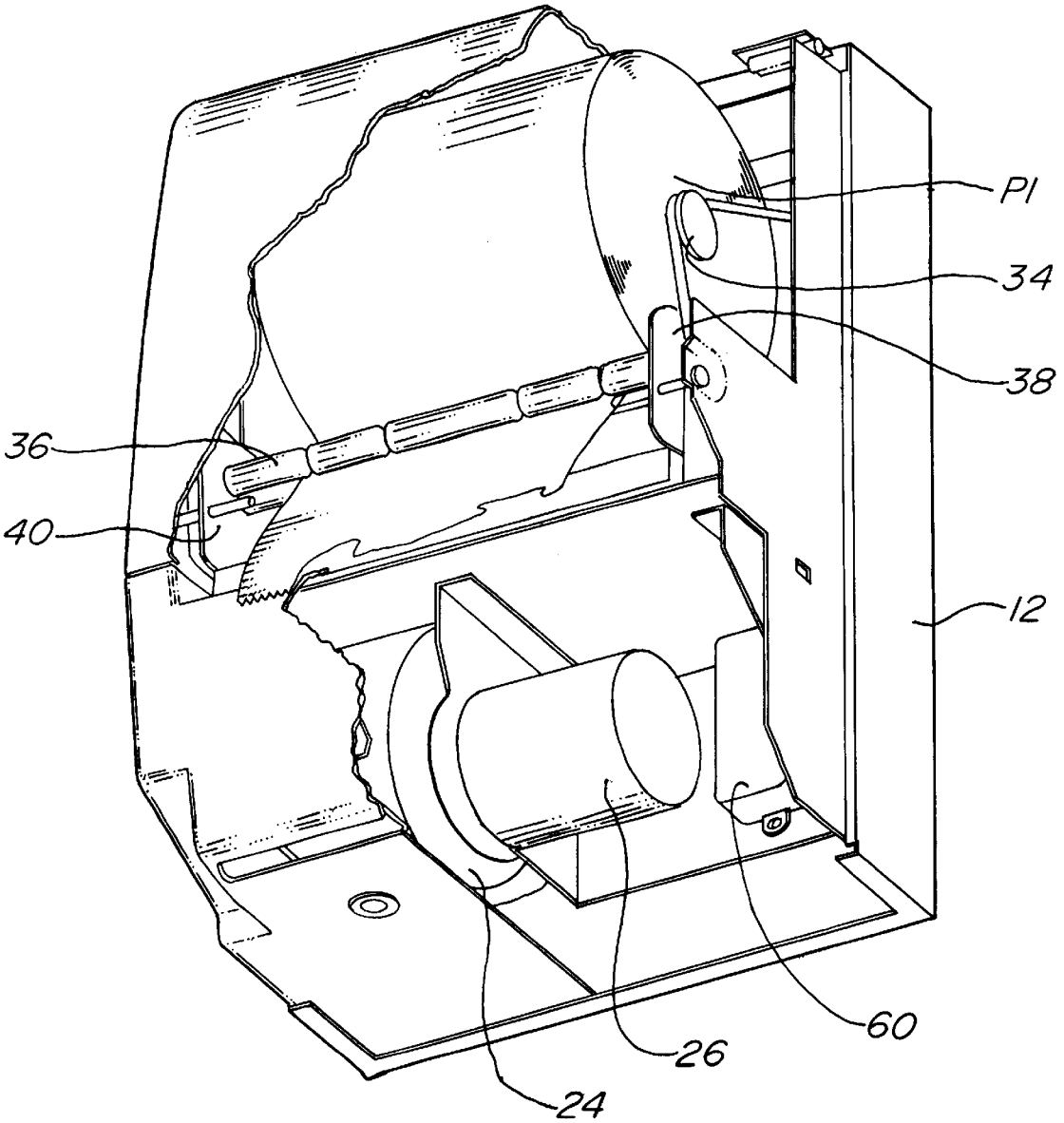
FIG. 4 is a lower perspective view of the combination drying unit having the cover partially cut away.
Figure 5:
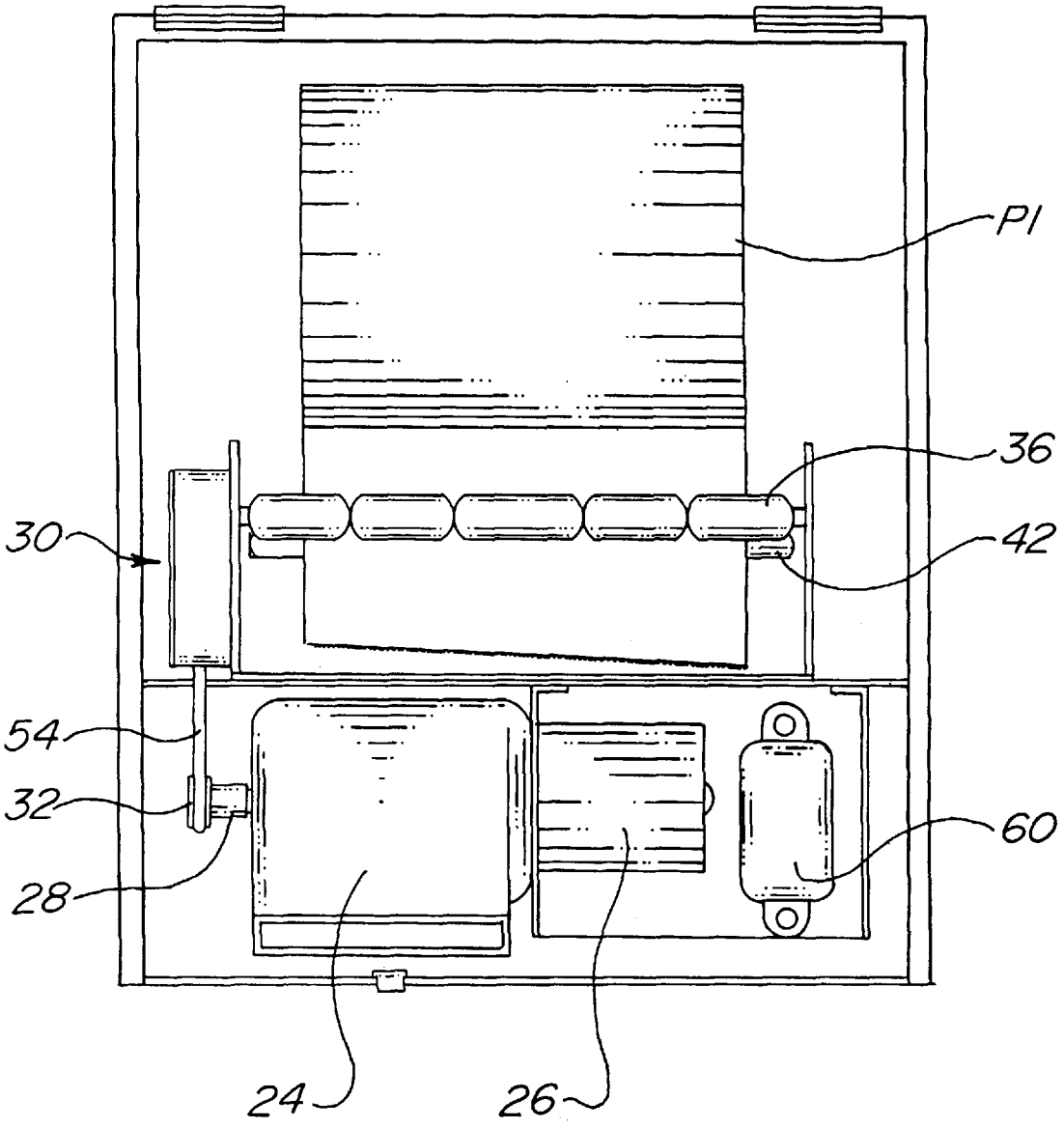
FIG. 5 is a front elevation view of the combination drying unit with the cover removed.

As seen in FIG. 3, a pair of core plugs 34 (only one illustrated) is attached to the housing 12 in spaced apart relation. The pair of core plugs 34 can be generally rigid members with at least one core plug 34 hingedly attached to the housing 12, or members wherein at least one core plug 34 has resilient properties such as a core plug 34 wherein the legs are formed from a resilient and rigid material such as spring steel or other suitable material. A paper towel roll P1 is rotatably received between the pair of core plugs 34. A first guide roller 36 is rotatably positioned within the housing 12 between a first extension 38 and a second extension 40 while a second guide roller 42 is rotatably positioned between the first extension 38 and the second extension 40 proximate the first guide roller 36. A roller shaft (not illustrated) is fixedly attached to and extends axially beyond the end of the first guide roller 36 such that the roller shaft passes through the second extension 40 and has second drive wheel 44 rotatably attached thereto.

It is recognized that the second guide roller 42 may be replaced with a plate (not illustrated) or other similar member.

Optionally located within the housing 12 proximate the pair of guide rollers 36 and 42 is a sensor 46 either electrical, optical or mechanical. The optional sensor 46, which can be of any appropriate design known in the art, detects the presence or absence of a towel stream between the first guide roller 36 and the second guide roller 42.

Figure 7:
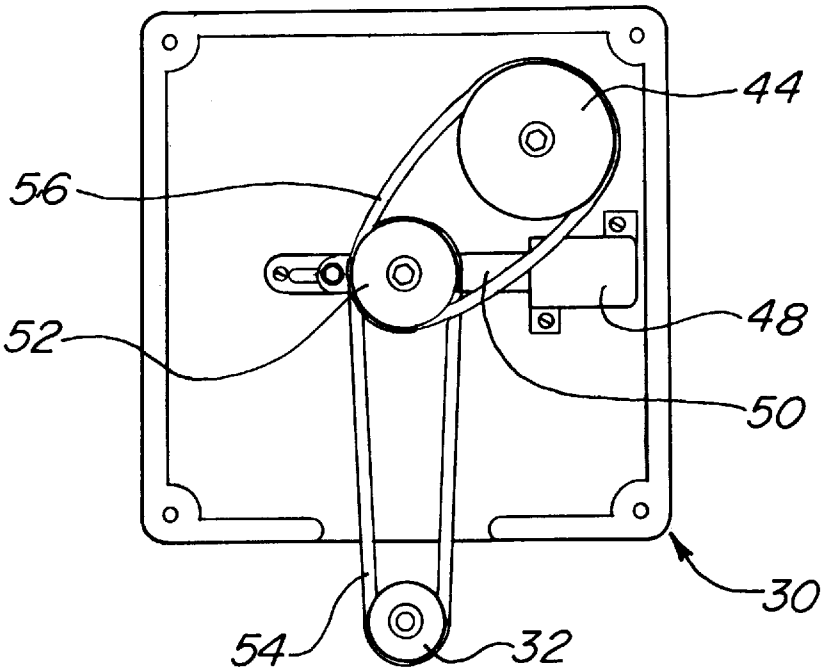
FIG. 7 is a side elevation view of the transmission unit in a disengaged position.
Figure 6:
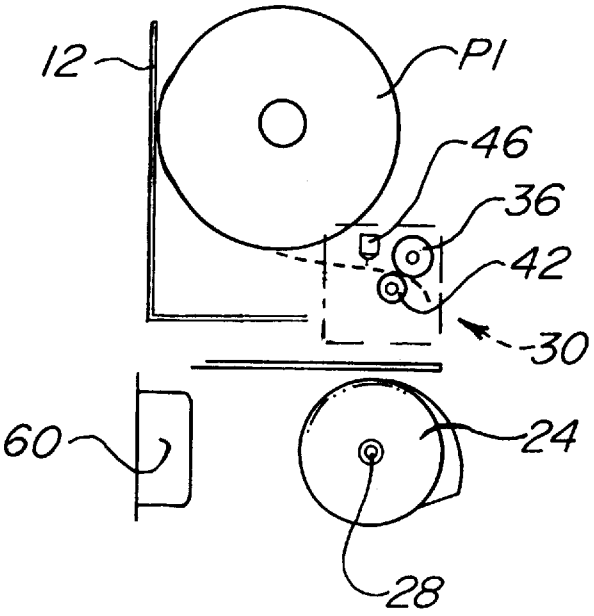
FIG. 6 is a side elevation view of some of the internal components of the combination drying unit.
Figure 8:
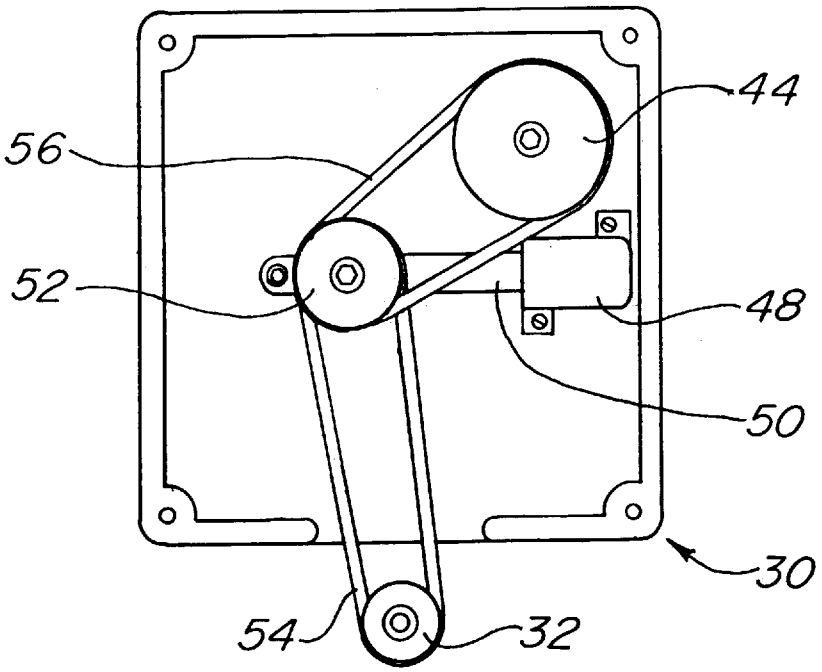
FIG. 8 is a side elevation view of the transmission unit in an engaged position.

The transmission unit 30, as seen in FIGS. 7 and 8, is comprised of a solenoid 48, having a solenoid shaft 50 extending therefrom, attached to the outer face of the second extension 40. The solenoid shaft 50 is positionable between a generally retracted position, illustrated in FIG. 7 and a generally extended position, illustrated in FIG. 8, responsive to solenoid 48 activation. A third drive wheel 52 is rotatably attached to the end of the solenoid shaft 50. A first continuous belt 54 extends between the first drive wheel 32 and the third drive wheel 52, while a second continuous belt 56 extends between the second drive wheel 44 and the third drive wheel 52. The first belt 54 and the second belt 56 are positioned on the third drive wheel 52 is spaced apart relation.

As seen in FIG. 7, whenever the solenoid shaft 50 is in its retracted position, the second belt 56 is slack. In this position, rotation of the third drive wheel 52 will not cause rotation of the second belt 56 and thus no rotation of the second drive wheel 44 will occur. As seen in FIG. 8, whenever the solenoid shaft 50 is in its extended position, the second belt 56 is taut. In this position, rotation of the third drive wheel 52 will cause rotation of the second belt 56 which in turn causes rotation of the second drive wheel 44. As seen in both figures, in either position of the solenoid shaft 50, the first belt 52 is always taut and thus rotation of the first drive wheel 32 will cause rotation of the first belt 54 and thus rotation of the third drive wheel 52.

It is recognized that the third drive wheel 52 (and thus the solenoid 48 and shaft 50 and the second belt 56 can be dispensed with such that the first belt 54 extends between the first drive wheel 32 and the second drive wheel 44 and is always taut such that rotation of the first drive wheel 32 will always cause rotation of the second drive wheel 44.

It is also expressly recognized that the illustrated drive wheel and belt transmission system can be replaced with any other transmission system known in the art, such as a gear mechanism or additional drive wheels disposed between the current drive wheels, that selectively or continuously transmits rotational power to the first guide roller 36 is response to the rotation of the motor shaft 28.

In order to utilize the combination drying unit 10 of the present invention, a towel roll P1 is loaded onto the first pair of core plugs 34. Depending on design, the core plugs 34 are either pivoted outwardly (in a rigid core plug 34 hingedly attached to the housing 12 design) or are "bent" outwardly (in a core plug 34 having resilient legs design) in order to place the towel roll P1 onto the core plugs 34. The core plugs 34 are thereafter returned to their original position to securely and rotatably hold the towel roll P1 therebetween. The end of the towel roll P1 is fed through the first guide roller 36 and the second guide roller 42 (or optional plate). The first guide roller 36 is positioned sufficiently close to the second guide roller 42 (or plate) such that the towel stream passing between the guide rollers 36 and 42 is frictionally engaged between the guide rollers 36 and 42 (or guide roller 36 and plate) and is advanced in response to the rotation of the first guide roller 36. Thereafter, the end of the towel roll P1 is fed through the second opening 18.

A user activates the activation means causing the motor 26 to activate and thus the air blower 24 to dispense a stream of air through the first opening 16. The user uses the stream of air to dry his hands or face. Either simultaneously with air dispension commencement (if continuous rotation of the first guide roller 36 is implemented, or alternately, if desired), or after a preset amount of time later—which amount may be selectable and changeable—the transmission unit 30 activates. This entails the solenoid 48 positioning the solenoid shaft 50 into its extended position thereby causing the second drive belt 56 to become taut. As motor 26 activation causes motor shaft 28 and first drive wheel 32 rotation, the first drive wheel 32 causes rotation of the third drive wheel 52. Upon the second belt 56 becoming taut, the third drive wheel 52 causes rotation of the second drive wheel 44 which causes rotation of its attached first guide roller 36. Rotation of the first guide roller 36 causes friction feeding of a towel stream from the towel roll P1 and through the second opening 18. After a preset amount of time—again this amount of time can be fixed or can be owner selectable and changeable—the motor 26 ceases causing air dispensing to cease and towel dispensing to cease. The solenoid shaft 50 returns to its retracted position. The dispensed towel may be removed from the towel roll P1 by tearing it along the cutting element.

The transmission unit 30 will be of appropriate dimension and design such that the relatively high RPM of the motor shaft 28 is transmitted to a relatively low RPM to the first guide roller 36. This RPM reduction also permits a relatively small motor 26 to deliver sufficient torque to dispense towels from a relatively large towel roll P1.

If the optional sensor 46 is utilized, and the towel stream is exhausted, the sensor 46 will sense this towel stream outage and will activate a signaling means usable with the device 10. The signaling means can be visual 58 (as seen in FIG. 1), audio or both. Alternately, or in addition to the audio or visual output, the signaling means can transmit, wirelessly or otherwise, the towel outage signal to a remote receiving station (not illustrated). This station can be located within a manager's office, on the belt of a busboy or other appropriate location. If desired, the device 10 can be designed such that whenever the sensor 46 detects a towel outage condition, the control means 60 of the device 10 can disable the solenoid 48 and thereby keep the solenoid shaft 50 in its retracted position until the towel roll P1 is replenished and sensed by the sensor 46.

The control means 60 for the device 10, can be located in any desired position, internal or external to the housing 12.

While the invention has been particularly shown and described with reference to an embodiment thereof, it will be appreciated by those skilled in the art that various changes in form and detail may be made without departing from the spirit and scope of the invention.

I claim:

1. A combination drying unit for dispensing an air stream and dispensing a towel stream from a towel roll comprising:

a housing having a first opening and a second opening;

a air blower, for dispensing the air stream through the first opening, disposed within the housing;

a towel dispensing means, for dispensing the towel stream through the second opening, disposed within the housing;

a drive means for powering the air blower and for powering the towel dispensing means, disposed within the housing; and an activation means for activating the drive means.

2. The combination drying unit as in claim 1 wherein the towel dispensing means comprises:

a pair of core plugs disposed within the housing, adapted to rotatably receive the towel roll therebetween; and an engagement means, for frictional advancement of the towel stream through the second opening.

3. The combination drying unit as in claim 2 wherein the engagement means comprises:

a first extension disposed within the housing;

a second extension disposed within the housing, in spaced apart relation to the first extension;

a first guide roller rotatably disposed between the first extension and the second extension;

an engagement surface means, located proximate the first guide roller, for frictional positioning of towel stream between a first guide means and for advancement of the towel stream responsive to the first guide roller rotation; and whereby the drive means is mechanically connected to the first guide roller and is capable of causing rotation of the first guide roller.

4. The combination drying unit as in claim 3 wherein the engagement surface means is comprised of a second guide roller rotatably disposed between the first extension and the second extension.

5. The combination drying unit as in claim 3 wherein the engagement surface means is comprised of a plate disposed between the first extension and the second extension.

6. The combination drying unit as in claim 3 wherein the drive means comprises:

a motor;

a first shaft, extending from the end of the motor, rotatable in response to the motor activation; and a transmission means, disposed between the first shaft and the first guide roller, for rotating the first guide roller.

7. The combination drying unit as in claim 6 wherein the transmission means comprises:

a first drive wheel rotatably attached to the first shaft;

a second shaft extending axially outwardly from the first guide roller and through the second extension;

a second drive wheel rotatably attached the second shaft; and a rotation means, disposed mechanically between the first drive wheel and the second drive wheel, for rotating the second drive wheel in response to the first drive wheel rotation.

8. The combination drying unit as in claim 7 wherein the rotation means comprises a continuous belt extending between the first drive wheel and the second drive wheel.

9. The combination drying unit as in claim 7 wherein the rotation means comprises at least one third drive wheel mechanically and rotatably connected between the first drive wheel and the second drive wheel.

10. The combination drying unit as in claim 6 wherein the transmission means comprises:

a first gear rotatably attached to the first shaft;

a second shaft extending axially outwardly from the first guide roller and through the second extension;

a second gear rotatably attached the second shaft; and at least one third gear mechanically and rotatably connected between the first gear and the second gear.

11. The combination drying unit as in claim 6 wherein the transmission means comprises:

a first drive wheel rotatably attached to the first shaft;

a second shaft extending axially outwardly from the first guide roller and through the second extension;

a second drive wheel rotatably attached the second shaft;

a rotation means, disposed mechanically between the first drive wheel and the second drive wheel, for selectively rotating the second drive wheel in response to first drive wheel rotation.

12. The combination drying unit as in claim 11 wherein the rotation means comprises:

a solenoid, having a third shaft articulatable between a retracted position and an extended position in response to solenoid activation;

a third drive wheel rotatably attached to the third shaft;

a first continuous belt extending between the first drive wheel and the third drive wheel;

a second continuous belt, extending between the second drive wheel and the third drive wheel; and whereby the first belt is always taut and the second belt is taut whenever the third shaft is in its extended position and the second belt is slack whenever the third shaft is in its retracted position.

13. The combination drying unit as in claim 1 wherein the activation means comprises a depression switch.

14. The combination drying unit as in claim 1 wherein the activation means comprises a sensing means for detection the presence of a user.

15. The combination drying unit as in claim 1 further comprising a heating element, located proximate the air blower, for heating the air stream.

16. The combination drying unit as in claim 1 further comprising a cutting means located proximate the second opening.

17. The combination drying unit as in claim 1 wherein the first opening is a nozzle.

18. The combination drying unit as in claim 1 further comprising;

a sensing means, disposed within the housing, for sensing the presence or absence of the towel stream within the towel dispensing means; and a display means, for displaying the status of the sensing means.

19. The combination drying unit as in claim 12 further comprising;

a sensing means, disposed within the housing, for sensing the presence or absence of the towel stream within the towel dispensing means;

a display means, for displaying the status of the sensing means; and disablement means, for disabling the solenoid and rendering the third shaft in its retracted position upon the sensing means sensing the absence of the towel stream.

* * * * *